US006338750B1

(12) United States Patent
Lorini

(10) Patent No.: US 6,338,750 B1
(45) Date of Patent: Jan. 15, 2002

(54) CLEANING APPARATUS

(75) Inventor: Paolo Lorini, Chiari (IT)

(73) Assignee: S.I.EL S.r.l., Castelcovati (IT)

( * ) Notice: Subject to any disclaimer, the term of this patent is extended or adjusted under 35 U.S.C. 154(b) by 0 days.

(21) Appl. No.: 09/504,736

(22) Filed: Feb. 16, 2000

(30) Foreign Application Priority Data

Mar. 5, 1999 (EP) ..... 99830119

(51) Int. Cl.[7] ..... B01D 47/02

(52) U.S. Cl. ..... 96/245; 15/353; 55/DIG. 3; 96/275; 96/276; 96/278; 96/333; 96/337

(58) Field of Search ..... 15/353; 55/DIG. 3; 95/24, 226; 96/245, 269, 275, 276, 278, 323, 309, 333, 334, 335, 337, 347, 348, 349, FOR 138, FOR 134, FOR 139

(56) References Cited

U.S. PATENT DOCUMENTS

| | | | | | |
|---|---|---|---|---|---|
| 941,676 | A | * | 11/1909 | Green | 96/334 |
| 1,155,272 | A | * | 9/1915 | Pollock | 96/348 |
| 1,363,859 | A | * | 12/1920 | Fetters et al. | 96/334 |
| 2,184,731 | A | * | 12/1939 | Brewer | 96/337 |
| 2,191,717 | A | * | 2/1940 | Jeffery | 55/DIG. 3 |
| 2,306,212 | A | * | 12/1942 | Gerstmann | 96/349 |
| 4,251,241 | A | * | 2/1981 | Bothun | 55/DIG. 3 |
| 4,676,811 | A | * | 6/1987 | Wade | 96/275 |
| 4,874,404 | A | | 10/1989 | Boswell | |
| 5,326,383 | A | * | 7/1994 | Harris | 96/349 |
| 5,725,623 | A | | 3/1998 | Bowerman et al. | |
| 5,752,997 | A | * | 5/1998 | Roth | 55/DIG. 3 |
| 5,776,215 | A | * | 7/1998 | Amoretti | 55/DIG. 3 |
| 5,797,163 | A | | 8/1998 | Whitaker et al. | |
| 5,958,113 | A | * | 9/1999 | Collins et al. | 55/DIG. 3 |

FOREIGN PATENT DOCUMENTS

| | | | | |
|---|---|---|---|---|
| DE | 2907395 | * | 9/1979 | 96/FOR 138 |
| EP | 0 768 058 A2 | | 4/1997 | |
| FR | 2 745 169 | | 8/1997 | |
| FR | 2 454 730 | | 11/1997 | |

* cited by examiner

*Primary Examiner*—Duane S. Smith
(74) *Attorney, Agent, or Firm*—Cobrin & Gittes

(57) ABSTRACT

Cleaning apparatus that has at least one suction device that sucks fluid toward the inside of the apparatus and is connected to an external suction duct. Interposed between the duct and the suction device is a device that holds back the solid particles present in the fluid. Such a holding back device includes at least one mixing chamber containing in part the liquid. A further device is provided that causes turbulence in this mixing chamber in such a way as to create a saturated environment of liquid in suspension above a free surface of the liquid contained in the mixing chamber.

17 Claims, 4 Drawing Sheets

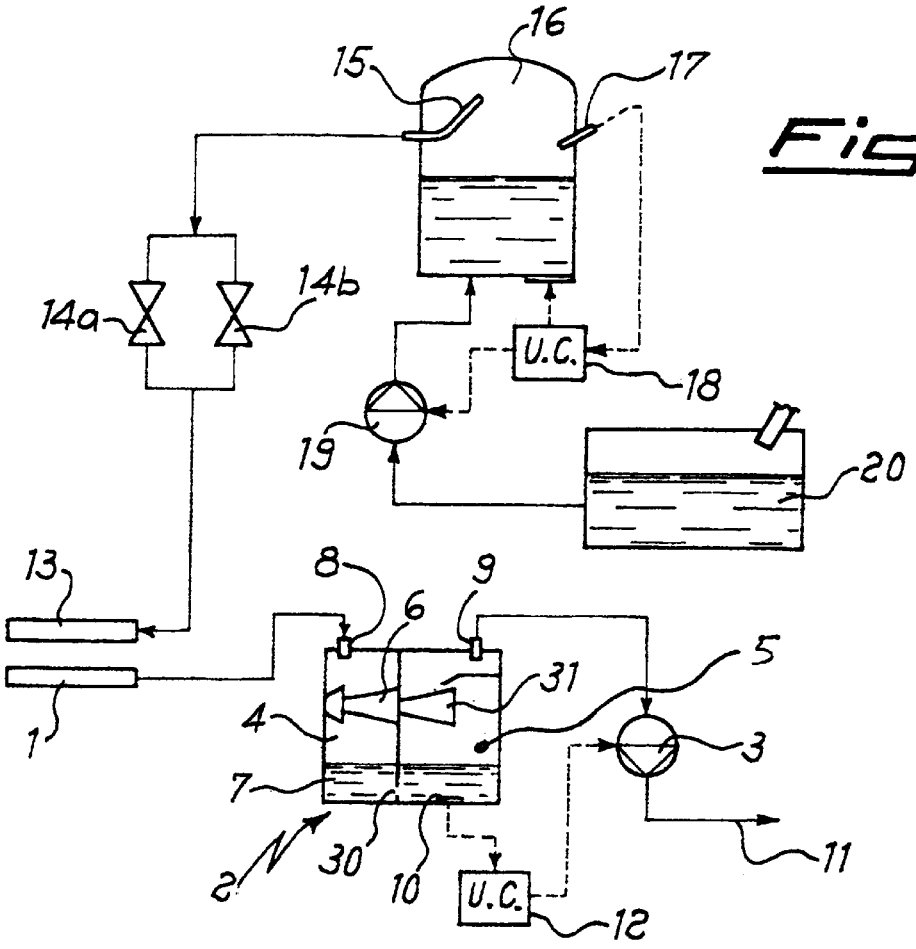
Fig. 1
Fig. 4
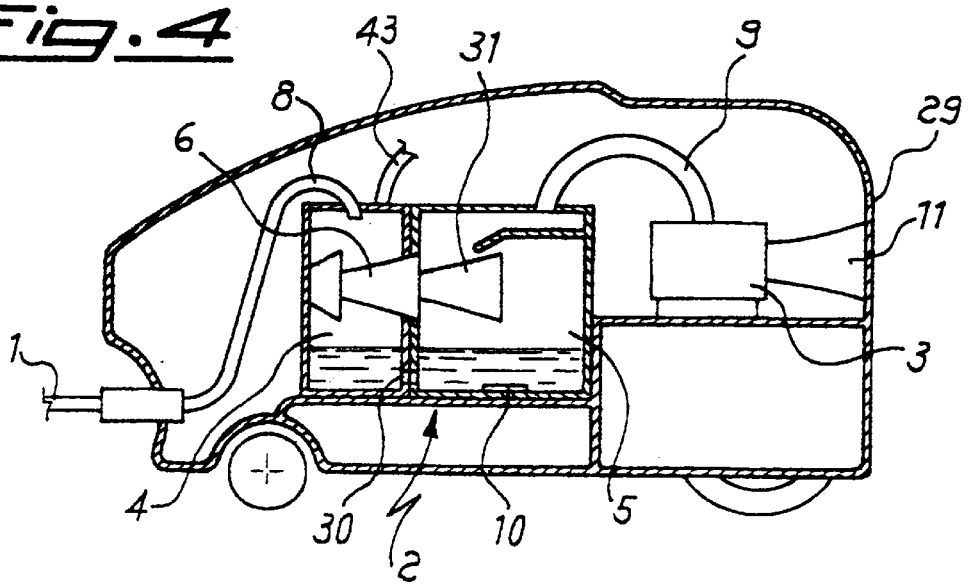

CLEANING APPARATUS

BACKGROUND OF THE INVENTION

FIELD OF THE INVENTION

The present invention relates to a cleaning apparatus of the type comprising at least one suction device of a fluid, connected to a suction duct, and means for holding back any solid particles present in the sucked fluid.

Domestic cleaning apparatus providing for suction of an air-flow containing solid particles, also known by the name "vacuum cleaner", usually comprises a suction pump connected to an external duct and means for separating and holding back the solid particles contained in the flow of sucked air. The suction pump creates an area of low air pressure in correspondence to the collecting section of the external duct, able to cause an air-flow containing any dust-or solid particles, directed toward the inside of the apparatus. Subsequently, the dust contained in the flow of sucked air is separated, for instance by means of a membrane filter, to allow clean air to be vented from the apparatus.

Therefore, in use, the operator directs the collecting section of the external duct, generally equipped with a shaped extremity, to above a specific surface of the object that needs cleaning and, operating, the pump, aspirates any solid particles present on the same surface into the cleaning apparatus. The airflow and sucked dust are induced to flow through a membrane filter, usually pouch-shaped, capable of holding back even very small solid particles. The membrane filter, however, placed between the collecting section and the suction pump, causes a notable loss of pressure in the suction circuit, and accordingly reduces the ability of the same apparatus to aspirate dust, because of the very small pore-dimension in the filtering membrane.

Furthermore, such membrane filter must be replaced regularly, because of the dust which accumulates during use and tends to offer increasing resistance to the flow of the air, involving the generation of a lower vacuum in correspondence to the collecting section of the suction duct and therefore degrading the performance of the cleaning apparatus. The operation of removal and substitution of the filter, which generally involves opening the body of the cleaning apparatus, separating the filter from the housing in which it is lodged, recovering the filter from the suction ducts and discharging it, assembling the new filter and closing the body, is not easy and requires the elimination, and consequent replacement of consumable materials.

Finally, whenever a liquid is erroneously sucked by the above described apparatus, the membrane filter (usually of paper material) could soften and tear because of the absorption of the same liquid. Such laceration would allow solid particles to flow into the suction circuit and to penetrate the suction pump, jeopardising the operation of the cleaning apparatus. Therefore, suction of liquids must be avoided by such apparatus.

On the other hand, cleaning apparatuses are known that, equipped with a steam generator and with means for the delivery of the steam, also comprise devices for the suction of liquids.

In such apparatuses, which allow the washing of the surfaces that are to be cleaned, a jet of steam under pressure is delivered that loosens any encrusted dirt and favours the mixing of the particles of dust with the water resulting from the condensation of the same steam. This mixture of water and dust is sucked simultaneously with the delivery of the steam by the cleaning apparatus and, for instance, made to fall by gravity—exploiting the weight of the mixture—into a collection container. In these embodiments, the sucked wet dust accumulates in the collection container and must be emptied regularly by the operator.

But, the cleaning apparatuses equipped with a steam generator and with means for the suction of liquids are not able to aspirate dry dust, or dust not mixed with water, because they don't comprise means for separating the dust from the air-flow, such as for instance a membrane filter. In similar apparatuses, to avoid dust not mixed with water damaging the same suction device, the operation of suction is activated only simultaneously with the delivery of the steam.

OBJECTS OF THE INVENTION

One purpose of the present invention is to provide a cleaning apparatus that is able to aspirate both dry solid particles and liquids present on a surface and to separate the solid particles and the liquid from the flow of discharged air.

A further purpose of the present invention is to provide a cleaning apparatus that is particularly versatile and easy to use.

Another purpose of the present invention is to get a cleaning apparatus that allows only the suction of dust from dry surfaces or, alternatively, the delivery of steam and the subsequent suction of dust mixed with water.

SUMMARY OF THE INVENTION

These and other purposes are achieved by the cleaning apparatus according to the principal claim and the following dependent claims.

A cleaning apparatus according to the present invention comprises a suction device of a fluid toward the inside of the apparatus connected to an external suction duct, and means of holding back the solid particles, located between the suction device and the external duct. Such means for holding back the solid particles comprises a mixing chamber partially filled with a liquid and means for causing turbulence in the mixing chamber, in such a way as to create in the latter a saturated environment of liquid in suspension above the free surface of the same liquid.

In a preferred form of embodiment, the cleaning apparatus comprises further means for the reduction of the speed of the sucked fluid interposed between the means for causing the turbulence and the suction device.

According to a particular aspect of the invention, the means for causing turbulence and the means for the reduction of the speed of the sucked fluid comprise a first Venturi tube in fluid communication with the mixing chamber and with a further collection chamber. The Venturi tube is arranged above the free surface of the liquid contained in the mixing chamber.

In a further embodiment of the cleaning apparatus according to the present invention, the said mixing chamber and the collection chamber are in fluid communication with each other, either below or corresponding to the free surface of the liquid initially contained in the mixing chamber.

According to a preferential embodiment of the invention, the means for causing the turbulence comprises a further Venturi tube placed downstream of the first Venturi tube. Furthermore, membrane filtering means are present at least partially located in the first Venturi tube.

In another particular form of embodiment, the Venturi tube is of the divergent type and presents the reduced portion entry section in fluid communication with the mixing chamber, and the divergent portion exit section in fluid communication with the collection chamber.

According to another aspect of the invention, the collection chamber presents a discharging duct connected to the suction device and a sensor of the level of liquid present in the collection chamber; the sensor is connected to means for interrupting the operation of the suction device in the event of the level of the liquid in the mixing chamber reaching or exceeding a pre-set threshold. In a further form of embodiment, the cleaning apparatus according to the invention comprises a reservoir for the water, as well as means for generating and delivering steam and/or water at high temperature connected to this reservoir.

Some preferential embodiments of the cleaning apparatus according to the present invention will now be described by way of example and not of limitation, with reference to the attached drawings, in which:

BRIEF DESCRIPTION OF THE DRAWINGS

FIG. 1 is a scheme of a cleaning apparatus according to a particular aspect of the present invention, comprising means for the generation and delivery of steam;

FIG. 4 is a schematic profile view, in section, of a particular cleaning apparatus according to the invention;

DESCRIPTION OF THE PREFERRED EMBODIMENTS

Figure 2:
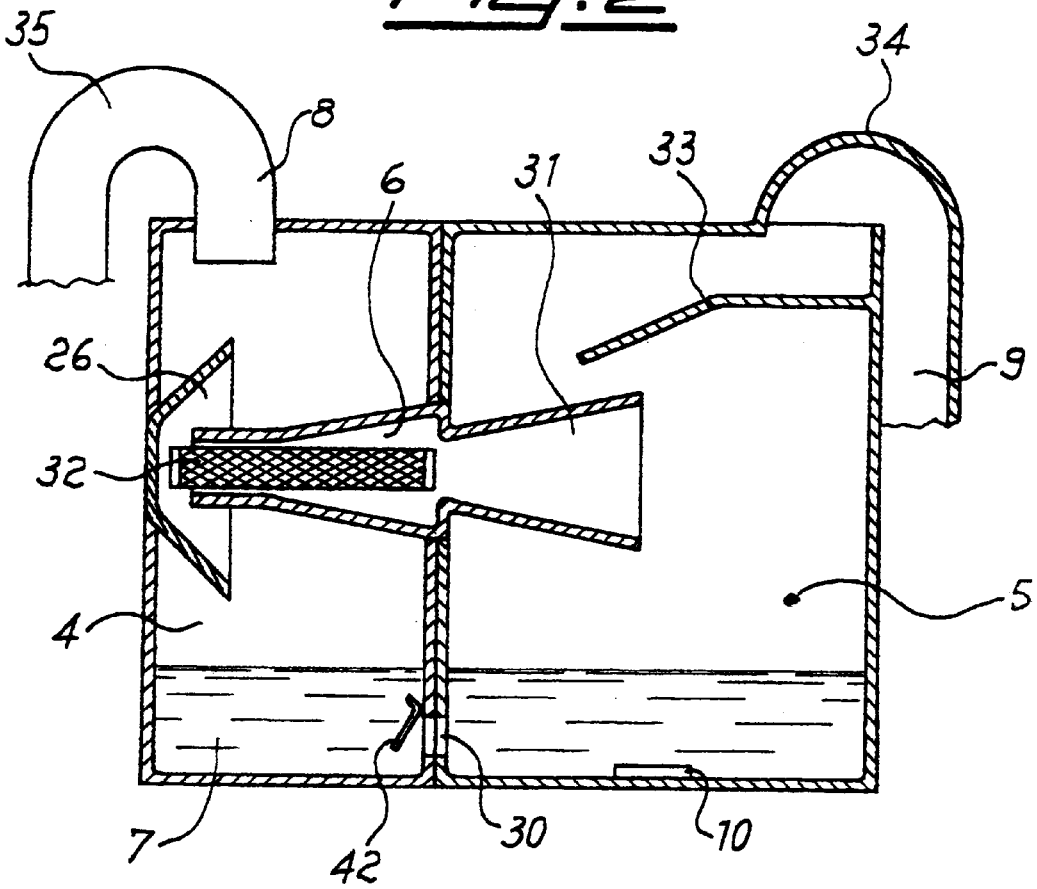
FIG. 2 is a side view in section of the mixing and collection chambers of a cleaning apparatus according to the invention.

FIG. 1 is a scheme of d particular embodiment of the invention in which the cleaning apparatus comprises means for the generation and delivery of steam.

This cleaning apparatus comprises an external suction duct 1 connected to a suction device 3 that creates an area of low air pressure in correspondence of the collecting section of the same duct 1. Between the duct 1 and the suction device 3 is interposed the means 2 for holding back the solid particles comprising a mixing chamber 4 in fluid connection with a further collection chamber 5. The mixing chamber 4, which is partially filled with a liquid 7, is directly connected with the intake section 8 of the duct 1 and is in connection with the collection chamber 5 by means of a connecting section 30, located under the free surface of the liquid present in the chambers 4 and 5, and by means of two Venturi tubes 6 and 31, set one upstream the other, above the free surface of the liquid 7.

The collection chamber 5 presents a discharging duct 9, connected to the suction device 3, and a level sensor 10 of the liquid present in chamber 5 connected to means 12 for interrupting the operation of the suction device 3 whenever the level of the liquid inside chamber 5 reaches or exceeds a pre-set threshold.

The low air pressure created by the device 3 in correspondence of the collecting section of the duct 1 is able to cause a flow directed toward the intake section 8 of the same duct 1, and therefore toward the mixing chamber 4, of any fluid in the gaseous or liquid state.

The fluid sucked toward the inside of the cleaning apparatus, containing dust or solid particles, goes on to the inside of chamber 4, where the dust mixes with the liquid present in the same chamber 4; this is followed by the precipitation of the heavier particles of dust mixed with the liquid. The lighter particles of dust mixed with the liquid are, instead, drawn by the airflow through the two Venturi tubes 6, 31 and arrive in the collection chamber 5, where, as a result of the reduction of speed in the flow of fluid that transports them due to the Venturi tubes 6, 31, they fall down. The sucked air in chamber 5 finally transits into the discharging duct 9 and is expelled from it via the vent 11, placed downstream of the suction device 3. The cleaning apparatus illustrated in the scheme of FIG. 1, furthermore comprises a reservoir 20 for the water in the liquid state that feeds, via a pump 19, a boiler 16 for the generation of steam. The boiler 16, where pre-set conditions of temperature and pressure are maintained, presents a manifold for collecting the steam 15. Downstream of the manifold 15, in fluid connection with it, are set two operator-controlled solenoid valves 14*a* and 14*b* to regulate the flow of steam to a delivery nozzle 13. The apparatus furthermore comprises a control unit 18, connected to a sensor 17 present in the boiler 16, that regulates the level of the liquid and the thermodynamic conditions in the same boiler 16.

This control unit 18 is also able to detect and control the level of the liquid in the reservoir 20, to prevent the operation of the cleaning apparatus in the case where there is not sufficient liquid available for its correct operation.

Figure 3:
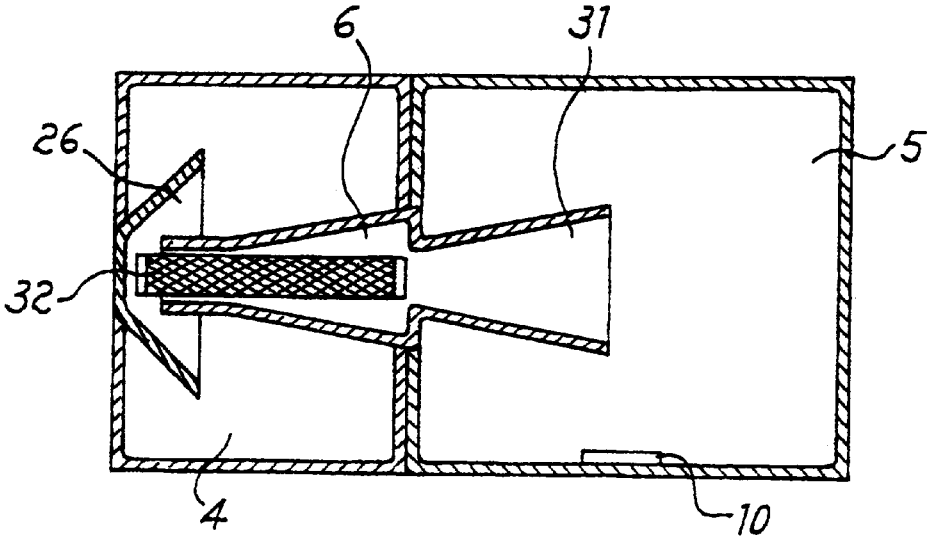
FIG. 3 is a top view in section of the mixing and collection chambers of FIG. 2.

FIGS. 2 and 3 show two views in section of the mixing and collection chambers, 4 and 5 respectively, of a further form of embodiment of the apparatus according to the present invention. In particular, chambers 4 and 5 are connected, above the free surface of the liquid 7, by means of two Venturi tubes 6 and 31 in series, and below the free surface of the liquid 7, by means of a passage 30. The passage 30, may be fitted with one-way valve means 42, allowing the flow of liquid only from chamber 5 to chamber 4 when the suction device is not in operation.

The collection chamber 5 is equipped with a baffle 33, fixed in proximity to the upper extremity of the same chamber 5, a discharging duct 9 connected to the suction device, as well as a level sensor 10 for the liquid, located in correspondence to the lower portion of the chamber 5.

The baffle 33 comprises a horizontal portion, extending from the vertical wall of the chamber 5 to the front of the Venturi tube 31, and an oblique portion that is partially superimposed on the exit section of the same Venturi tube 31 and is tilted toward the lower extremity of the same chamber 5. This baffle 33 has the function of breaking the flow of fluid, particularly air, coming out from the Venturi tube 31 and of preventing dust carried by the sucked fluid from directly reaching the discharging duct 9.

The level sensor 10, whenever the level of the liquid 7 in the two chambers 4 and 5 climbs above, or falls below a pre-set threshold, generates a signal that is transmitted to suitable means of control (not shown) and causes the interruption of the operation of the suction device. Therefore, if the level reached by the liquid in the chambers 4 and 5 exceeds or is under a threshold that is essential for the correct operation of the apparatus, the operation of the suction device is interrupted to allow the operator to either empty or fill the two chambers.

The signals generated by the sensor 10, respectively to indicate the excess or the lack of liquid in the chambers 4 and 5, can also pilot suitable means of signalling the "apparatus status", for instance bright warning lights, (not shown) to allow the operator to quickly identify the cause of the interruption of the operation of the apparatus.

Corresponding to the ceiling of chamber 4, above the Venturi tube 6, there is furthermore present the intake section 8 of the external collecting duct of the apparatus. The discharging duct 9 and the intake section 8 of the suction duct present two elbow portion, indicated by 34 and 35 respectively, which, although involving light losses of pressure, allow the external dimensions of the cleaning apparatus to be contained.

The Venturi tube 6 and the Venturi tube 31, reciprocally connected one within the other, are of the divergent type, both present a reduced entry portion of the fluid and a divergent exit portion of the same fluid. The Venturi tube 6, particularly, presents the reduced portion entry section in fluid communication with the mixing chamber 4 and the divergent portion exit section in fluid communication with the reduced entry portion of the Venturi tube 31. The Venturi tube 31 presents, in turn, its own divergent exit portion in fluid communication with the collection chamber 5. In proximity to the entry section of the Venturi tube 6 is furthermore located, partially superimposed on the latter, a cup 26 that defines a nonlinear course for the flow of fluid directed toward the Venturi tube 31 and, accordingly, toward the collection chamber 5.

According to a particular aspect of the invention, furthermore, a cylindrical membrane filter 32 can also be present, located partially inside the Venturi tube 6. The filter 32 comprises an impermeable material, even metal, and is endowed with pores not having an excessively reduced diameter, since they must hold back solid particles of not elevated mass mixed with portions of liquid present in the chambers 4 and 5. The not excessively reduced diameter of the pores of the membrane makes the losses of pressure, due to the same membrane, particularly contained. Advantageously, such filter 32 is removable from the seat indicated and could easily be cleaned of any impurities, by means of washing.

The low air pressure created by the suction device in the collecting duct, causes a flow of fluid directed toward the same suction device which, coming out of the intake section 8 of the collecting duct, is introduced into the chamber 4 partially filled with a liquid 7. The presence in the chamber 4 of the Venturi tube 6, which causes a further air pressure fall corresponding to its own entry section, favours the creation of vortexes and turbulent motions that involve both the gaseous phase and the liquid phase present in the same chamber 4. Consequently, inside chamber 4 there is created a saturated environment of liquid in which turbulence in the fluids present is propagated.

The environment thus produced facilitates the mixing of the solid particles present in the sucked fluid with the particles of liquid present in suspension in chamber 4 and the separation of this mixture from the same sucked fluid. After the mixing, the particles of higher mass tend to fall, by gravity, toward the bottom of the chamber 4 into the liquid 7, while the particles of lower mass are drawn, with the flow of sucked fluid, into the Venturi tube 6 and from there into the Venturi tube 31 to be introduced into the collection chamber 5.

The flow of sucked fluid, containing dust particles of reduced mass, undergoes a first reduction of speed corresponding to the exit section of the first Venturi tube 6 and a further reduction of speed corresponding to the exit section of the second Venturi tube 31. Because of this reduction in speed of the sucked fluid, which is caused in the collection chamber 5 due to the divergent Venturi tubes 6 and 31, the particles of inferior mass are no longer supported by the sucked fluid and fall by gravity to the bottom of the same chamber 5.

Finally, when the liquid 7 present in the collection chamber 5, and in the mixing chamber 4, exceeds a pre-set level, and provokes the trip-out of the suction device by the sensor 10, the operator can simply extract the chambers 4 and 5 together, empty them and reinsert them to continue using the apparatus. FIG. 4 illustrates, schematically, a particular form of embodiment of a domestic cleaning apparatus according to the present invention. This apparatus comprises a body 29, mounted on wheels to give mobility, having a suction duct. 1, an electrically-driven suction device 3, as well as a mixing chamber 4 connected by means of two Venturi tubes 6 and 31 in series to a collection chamber 5. The two chambers 4 and. 5 are further connected by a connecting passage 30 located below the level of the free surface of the liquid. In the fig. a duct 43 for the partial filling of the chamber 4 with a liquid and a vent 11 for the sucked fluid are shown.

The presence of the liquid 7 (water, for instance) in the mixing chamber 4, with the function of mixing the dust present in the sucked fluid, thus allows the apparatus to suck both dry dusts and the wet dust and liquids. So, the operator can, by partially filling the mixing chamber with a suitable quantity of water, clean dry surfaces, or wet surfaces, or aspirate liquid from a container, using the same cleaning apparatus.

Furthermore, in particular forms of embodiment of the present invention equipped with means for the generation and delivery of steam and/or water at high temperatures, the operator could employ this apparatus equally either as a traditional vacuum cleaner or as a steam-cleaning apparatus.

Figure 5:
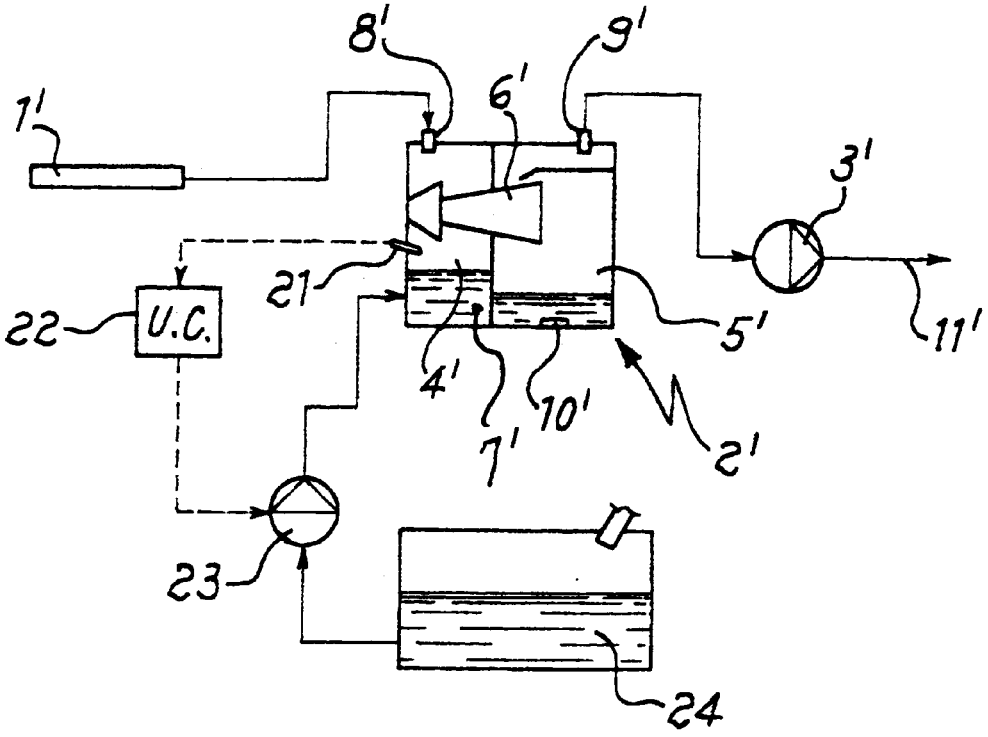
FIG. 5 is a scheme of a further embodiment according to the invention.

FIG. 5 shows a scheme of a cleaning apparatus according to another aspect of the present invention.

This apparatus comprises a suction duct 1' having an intake section 8' connected to a mixing chamber 4'. The mixing chamber 4', partially filled by a liquid 7', for instance water, is in turn connected, by means of a single Venturi tube 6' to a collection chamber 5'. The collection chamber 5' is in fluid communication with a discharging duct 9', connected in turn to a suction device 3' and to a vent 11'. The employment of a single Venturi tube 6' makes, for parity of dimension, the operation of separation of the dust from the sucked s fluid less effective, but the apparatus is simpler to construct.

The mixing chamber 4' and the collection chamber 5', furthermore, are no longer connected below the free surface of the liquid and therefore, the level of the free surface itself of the liquid in the two chambers 4' and 5' is different. This situation, while not influencing the operation of the apparatus, involves the need to employ two different level sensors 21 and 10' for the liquid in the two chambers 4' and 5' and for more rapid filling of the mixing chamber 4'.

The apparatus comprises a reservoir for the water 24 connected to a pump 23 for the filling of the mixing chamber 4. The pump 23 is operated by a control unit 22 connected to a sensor 21 for the detection of the level of the liquid present in the chamber 4'. When the level of the free surface of the liquid in the chamber 4' is below a pre-set threshold, the control unit 22 operates the pump 23 that feeds the chamber 4' from the liquid present in the reservoir 24 until the optimal level of the liquid inside the same chamber 4' is restored. The employment of the control unit 22, in partnership with the pump 23 and the reservoir 24, prevents incorrect use of the cleaning apparatus whenever there is not sufficient liquid in the chamber 4'.

The collection chamber 5' is, in turn, equipped with a sensor 10' to survey the level of the free surface of the liquid present in the same chamber 5' connected to means for the interruption of the operation of the suction device 3'. When the level of the free surface of the liquid present in the collection chamber 5' exceeds a determined level, the sensor 10' generates a signal that, due to the above-mentioned means of interruption, causes the operation of the suction device 3' to be interrupted.

Figure 6:
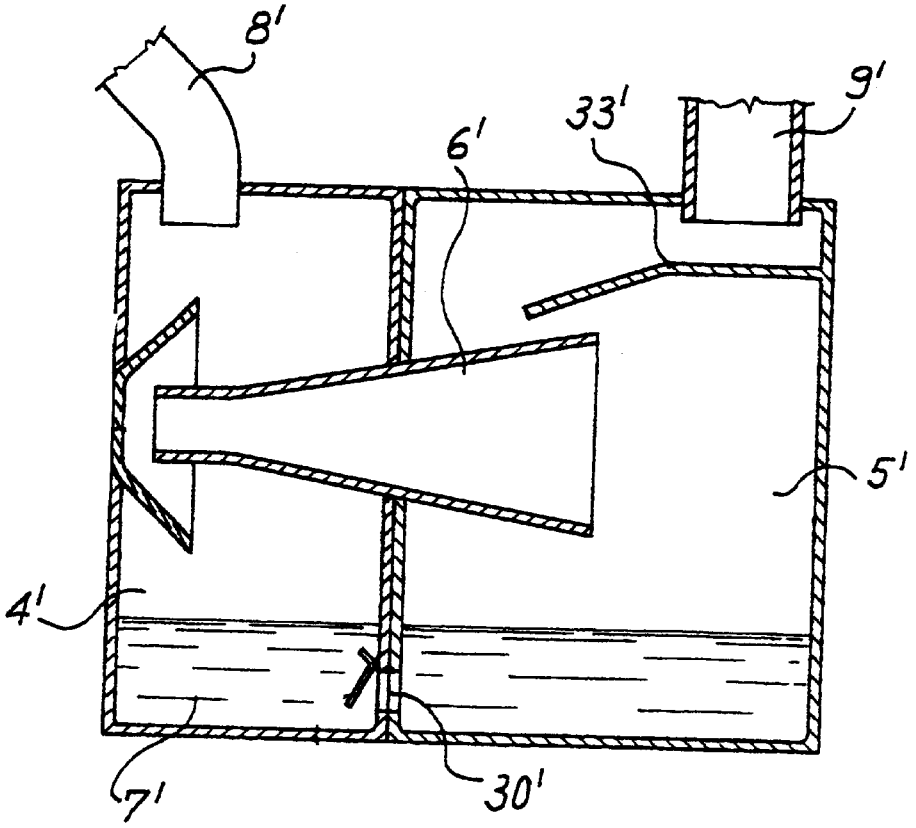
FIG. 6 is a side view in section of a mixing chamber and of a collection chamber of a cleaning apparatus according to a different form of embodiment of the invention.
Figure 7:
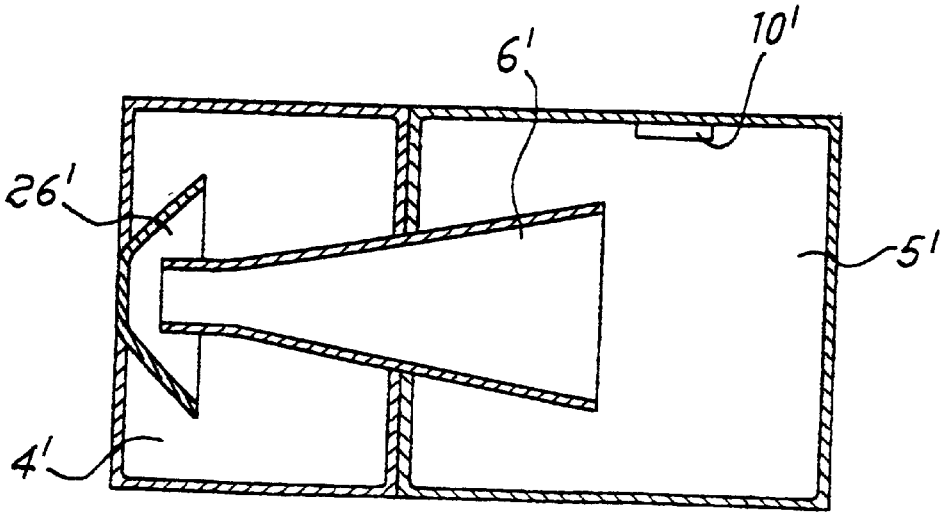
FIG. 7 is a top view in section of the mixing chamber and of the collection chamber of FIG. 6.

The apparatus represented in the scheme of FIG. 5 can furthermore be advantageously joined to means for the generation and delivery of steam and/ or water at high temperature, sharing with these latter the use of only one reservoir for the feeding of water to the boiler 16 (FIG. 1) and to the mixing chamber 4 or 4'. FIGS. 6 and 7 show views in section from the side and from the top respectively, of a particular embodiment of the mixing and of collection chambers connected by means for causing turbulence according to another aspect of the invention.

In particular, the mixing chamber 4' and the collection chamber 5' are in fluid communication, due to the passage 30', either in correspondence with their lower extremity, or below the free surface of the liquid 7' initially contained in the mixing chamber 4'. The mixing chamber 4' in proximity of whose ceiling is present the intake section 8' of a duct of external suction, is in fluid communication with the collection chamber 5' by means of a Venturi tube 6' located above the free surface of the liquid 7' present in the chambers 4' and 5'.

The collection chamber 5' is, in turn, in fluid connection with the discharging duct 9' that could carry a filtering element (not shown), placed upstream of the same suction device.

Furthermore, the collection chamber 5' presents a baffle 33,' extending for all the width of the same chamber 5', located in front of the divergent exit section of the Venturi tube 6. The baffle 33,' thus located, has the function of breaking the flow of fluid, particularly of air, coming out from the same Venturi tube 6' and preventing the dust drawn from the fluid directly reaching the discharging duct 9'.

To prevent the free surface of the liquid in the chambers 4' and 5' exceeding such a level as to jeopardise the operation of the cleaning apparatus, the employment of a level sensor 10' of the liquid in the chamber 5' is proposed. Whenever the liquid in the chambers 4' and 5' goes beyond a pre-set level, the means (not shown) for interrupting the operation of the suction device of the fluid come into operation. The sensor 10' can also operate such means for interrupting the operation of the suction device whenever the free surface of the liquid in the chambers 4' and 5' reach or exceed a pre-set level.

Figure 8:
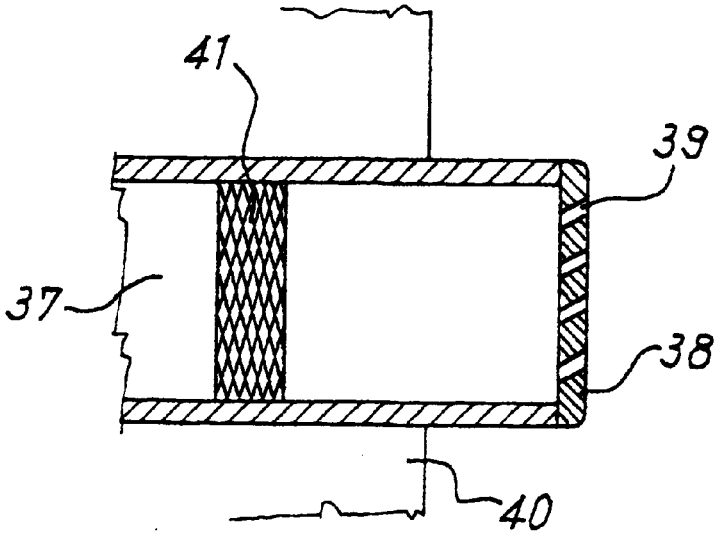
FIG. 8 is a profile view in section of the vent duct of a cleaning apparatus, according to a particular aspect the invention.

FIG. 8, finally, shows the terminal section of a vent duct 37 of the sucked fluid, placed downstream of the suction device and partially projecting from the body 40 of the cleaning apparatus. In particular, the terminal section of the vent duct 37 is of circular form and presents a grate 38, for venting the air toward the external environment, that is equipped with slits 39 tilted upwards, to prevent the jet of venting air going toward zones not yet cleaned and disturbing and raising the dust present there.

The vent duct 37 could be endowed with a filtering element 41 placed downstream of the suction device. Corresponding to this filtering element 41 could be placed, in a suitable container permeable to the air, a perfuming substance for the air-flow in exit. The cleaning apparatus according to the present invention is particularly effective and versatile, because it can be used indiscriminately for the cleaning of dry surfaces or of wet surfaces and could be fitted easily with means for the generation and delivery of steam and/or water at high temperatures.

The cleaning apparatus according to the present invention, is particularly efficient and doesn't require the employment of filters with extremely reduced pore diameter that involve considerable loss of pressure in the suction circuit, with consequent reduction in the air pressure of suction in the collecting section of the external duct.

Furthermore, this apparatus is easy and economical to use, since it does not need complicated operations for the elimination of the accumulated dust and doesn't require regular replacement of spare-parts.

What is claimed is:

1. A cleaning apparatus comprising an external suction duct; at least one suction device configured and arranged to suck a fluid toward an inside of the apparatus and being connected to said external suction duct; and holding back means for holding back the solid particles present in said fluid, characterized in that said holding back means is interposed between said external suction duct and said suction device and comprises at least a mixing chamber partly containing a liquid, turbulence means for causing turbulence in said mixing chamber in such a way as to create a saturated environment of liquid in suspension above a free surface of the liquid contained in said mixing chamber, and reducing speed means for reducing speed of the sucked fluid, said speed reducing means being placed between said turbulence means and said suction device.

2. The cleaning apparatus according to claim 1, characterized in that the mixing chamber of said suction duct has an entry section that is above the free surface of the liquid present in said mixing chamber.

3. The cleaning apparatus according to claim 1, characterized in that said holding back means also comprises at least one membrane-filtering element.

4. The cleaning apparatus according to claim 1, characterized in that said turbulence means and said reducing speed means comprise at least one first Venturi tube in fluid communication with said mixing chamber; and further comprising a further collection chamber connected to said suction device, said first Venturi tube being arranged to be above the free surface of the liquid initially present in said mixing chamber.

5. The cleaning apparatus according to claim 4, characterized by a further Venturi tube placed, in fluid connection, immediately downstream of said first Venturi tube.

6. The cleaning apparatus according to claim 5, characterized in that said first Venturi tube has a divergent structure, the divergent structure having a reduced dimensional portion with an entry section and having a divergent portion with an exit section, the entry section of the reduced dimensional portion being in fluid communication with said mixing chamber, the exit section of the divergent portion being in fluid communication with said further collection chamber, directly or through a further Venturi tube.

7. The cleaning apparatus according to claim 6, characterized in that said entry section of said first Venturi tube is set into a hollow of a cup element.

8. The cleaning apparatus according to claim 4, characterized in that said holding back means also comprises at least one membrane-filtering element that is at least partially in said first Venturi tube.

9. The cleaning apparatus according to claim 5, characterized in that said collection chamber is equipped with a baffle arranged in correspondence with an exit section of one of said first Venturi tube and said further Venturi tube to break a flow of fluid coming out of said exit section.

10. The cleaning apparatus according to claim 4, characterized in that said mixing chamber and said collection chamber are in fluid connection below, or in correspondence to, the free surface of the liquid initially present in said mixing chamber, by means of a connecting section.

11. The cleaning apparatus according to claim 10, characterized by a valve means for the unidirectional passage of liquid, located in correspondence with said connecting section.

12. The cleaning apparatus according to claim 4, characterized by detecting means for detecting a level of the free surface of the liquid, interrupting means for interrupting operation of said suction device, said detecting means being connectable to said interrupting means.

13. The cleaning apparatus according to claim 1, characterized by at least one reservoir for water.

14. The cleaning apparatus according to claim 13, characterized by generating means for generating at least one of steam and water at high temperature, said generating means being connected to said reservoir, as well as means for delivery toward outside of the one of steam and water at high temperature.

15. The cleaning apparatus according to claim 13, characterized by maintaining means for maintaining a free surface of the liquid present in said mixing chamber at a level within a pre-set range, said maintaining means being in fluid connection with said reservoir for water.

16. The cleaning apparatus according to claim 1, comprising a vent duct located downstream of said suction device and in fluid connection with said suction device characterized in that an exit section toward an external environment of said vent duct comprises a grate equipped with slits for the venting of the fluid, said slits being titled upwards.

17. The cleaning apparatus according to claim 1, comprising a vent duct located downstream of said suction device, said vent duct being in fluid connection with said suction device, characterized by a filtering element set at least before an exit section of the fluid toward an external environment of said vent duct.

* * * * *